US005713115A

United States Patent [19]

Knoepfel et al.

[11] Patent Number: 5,713,115

[45] Date of Patent: Feb. 3, 1998

[54] ELECTRONICALLY REGULATED APPARATUS FOR COILING SPRINGS

[75] Inventors: Hans Knoepfel, Roggwil; Siegfried Grueninger, St. Gallen, both of Switzerland

[73] Assignee: Spuehl AG, St. Gallen, Germany

[21] Appl. No.: 644,328

[22] Filed: May 10, 1996

[30] Foreign Application Priority Data

May 11, 1995 [DE] Germany ..... 195 17 260.4

[51] Int. Cl.[6] ..... B21F 3/02

[52] U.S. Cl. ..... 29/33 F; 72/135; 140/103

[58] Field of Search ..... 29/33 F; 72/132, 72/135, 137, 138; 140/103

[56] References Cited

U.S. PATENT DOCUMENTS

| | | | |
|---|---|---|---|
| 3,906,766 | 9/1975 | Sato | 72/132 X |
| 4,112,721 | 9/1978 | Takase | 72/138 X |
| 4,444,036 | 4/1984 | Shibata et al. | 72/138 |
| 4,594,869 | 6/1986 | Matsuoka | 72/135 X |
| 4,873,854 | 10/1989 | Russell et al. | 72/138 X |
| 4,991,277 | 2/1991 | Itaya | 140/103 X |
| 5,243,746 | 9/1993 | Shinichi | 140/103 X |
| 5,259,226 | 11/1993 | Itaya | 72/138 |
| 5,442,944 | 8/1995 | Lu | 72/137 |

FOREIGN PATENT DOCUMENTS

| | | |
|---|---|---|
| 81 105 289.3 | 7/1981 | European Pat. Off. . |
| 89 119 157.9 | 10/1989 | European Pat. Off. . |
| 74 25496 | 7/1974 | France . |

*Primary Examiner*—William R. Briggs

*Attorney, Agent, or Firm*—Lackenbach Siegel Marzullo Aronson & Greenspan, P.C.

[57] ABSTRACT

Described is an electronically regulated coiling apparatus for mattress and upholstery springs comprising essentially a wire draw-in, a wire guidance, a cutting device and a bending device for a wire to be processed, and due to short drive trains equipped with few transfer elements, in particular for the bending device, improved torsional rigidity and flexural strength of the particular drive train is attained. The electronically regulated servomotors used according to the invention can therefore transfer their movement directly onto the bending tools and the drive rollers by interconnecting few transfer elements. This permits bending a wire with decreased tolerances into a corresponding spring.

9 Claims, 5 Drawing Sheets

Härten

Figure 1:
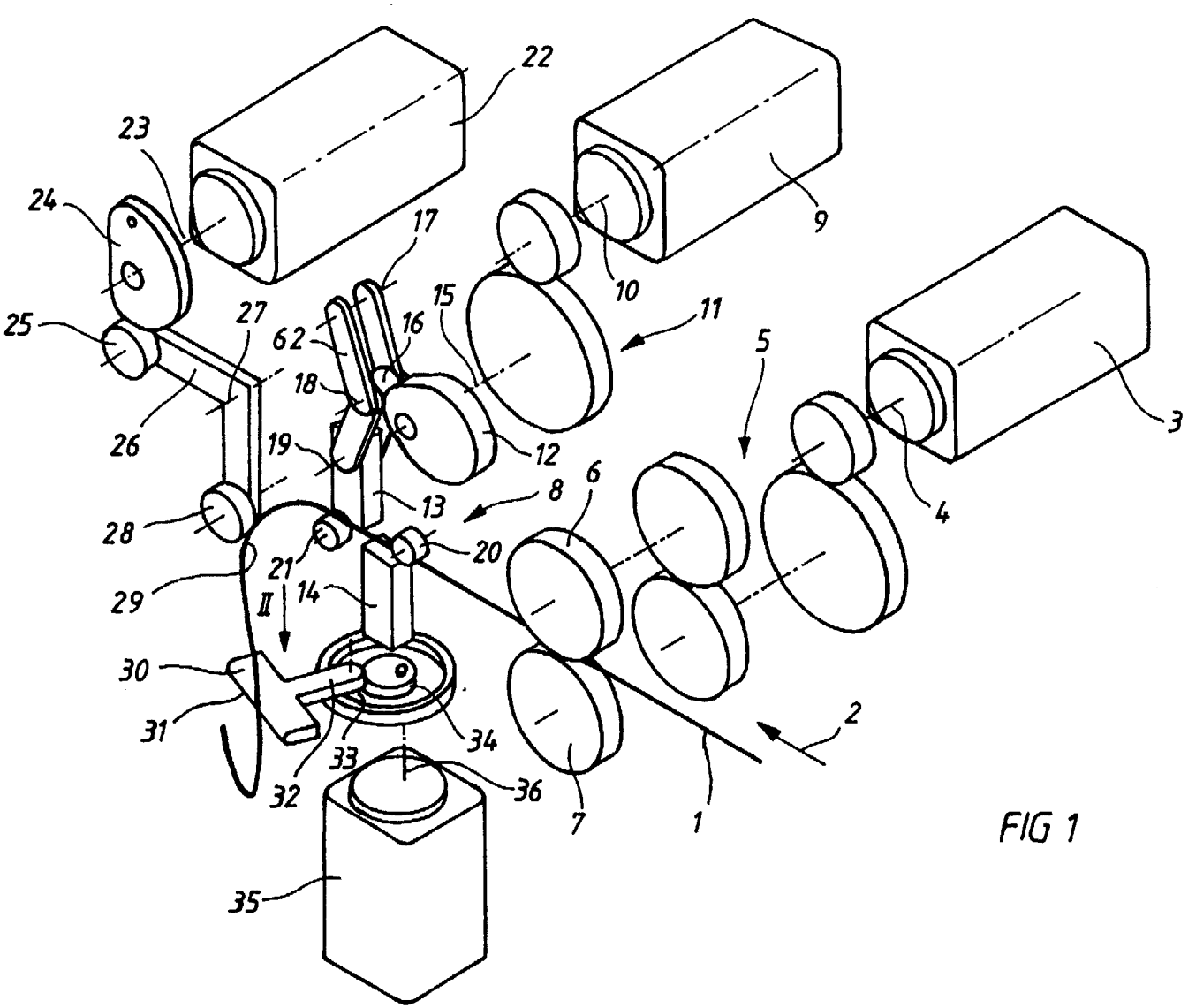

Achse 1
2
3
4
5
6
7
8
9
M
R
51
52
53
54
54a
54b
55
56
57
58
59
60
61
64
35
22
9
3

ELECTRONICALLY REGULATED APPARATUS FOR COILING SPRINGS

Subject matter of the invention is an electronically regulated coiling apparatus according the preamble of patent claim 1. Such coiling apparatus is known for example from the subject matter of EP 0 369 173B1. This known coiling apparatus has the disadvantage that the tools for bending the spring diameter, for effecting the pitch and for the wire feed are driven via relatively long driving mechanisms with play. Such driving mechanisms are in particular belts which are driven by corresponding electronically regulated driving motors.

Each driving motor acts via a toothed belt on a corresponding drive axle which is connected with transfer elements so as to be torsion tight, which tranfer elements comprise essentially cam wheels connected with associated rollers sensing the cam wheels. These sensing tools are, in turn, connected with the bending tools.

In such known coiling apparatus the disadvantage is accordingly encountered that due to the play-affected drive of the individual bending tools it is not possible to produce the spring to be bent with low tolerances.

Because of the use of the previously cited toothed belts, because of the use of long drive shafts and associated sensing instruments, there results a play-affected transfer of the drive power of the individual drive motors onto the bending tools. Thus the known configuration entails the disadvantage of lacking torsional rigidity and flexural strength of the entire drive Moreover, the known apparatus has the disadvantage that many mechanical parts must be used which significantly increases the production costs of the machine and also raises the maintenance expenditures, susceptibility to repair and the frequency of wear.

The invention therefore addresses the problem of further developing a coiling apparatus of the above cited type so that the individual drive trains are provided with improved torsional rigidity and flexural strength.

To solve the posed problem the invention is characterized by the technical teaching of claims 1 and 2.

An essential characteristic of the invention is that now, due to the short drive trains equipped with few transfer elements, improved torsional rigidity and flexural strength of the particular drive train are attained. The electronically regulated servomotors used according to the invention can therefore transmit their motion directly onto the bending tools and the drive rollers by interconnecting few transfer elements. This permits for the first time to bend a wire with decreased tolerances to form a corresponding spring.

Therewith the further advantage exists that even after several operating hours of the machine it is always ensured that a spring with precisely reproducible dimensions is generated without unacceptable deviations in the spring dimensions.

Consequently, this is a substantial quality improvement relative to the known systems.

The given technical invention results in the further advantage that it is now for the first time possible within wide limits to produce sequentially different springs, which has not been possible with the previously known drive systems.

According to the characteristics of the invention the reason for this is that the servomotors are electronically regulated and the motion of the servomotors can be precisely set according to the required spring form.

It is thus for the first time possible to produce sequentially for example a number of soft springs (with relatively large spring diameter) and subsequently a number of springs with relatively small spring diameter in order to supply the springs successively to a transferring machine which mounts these springs to form a mattress. Thus it is now possible to combine in the mattress regions with one another with harder springs and with softer springs.

With the given technical teaching thus a coiling apparatus is proposed with which practically any desired spring form of a spring can be realized without needing to exchange cam wheels or bending tools.

According to the invention the spring to be produced is first described with a mathematical model which is entered into the regulation system. The motion processes of the individual servomotors are driven according to this regulation. Due to the derivation from a mathematical model it is thus now possible to generate a modified spring form relatively fast because the production of different trial springs becomes now superfluous. Previously, in the case of known machines, trial springs had to be produced in large numbers so that based on the obtained spring form the drive chain could be newly adjusted so that the desired spring form was attained. This is no longer necessary in the present invention because, starting from a mathematical model, the different control commands for the various servomotors are programmed in directly and therefore rejected springs not suitable for further processing are to a large extent avoided.

It is in particular now possible to enter on the control different spring forms. According to the spring form entered, the control commands required for this purpose for the servomotors are read from a library and the motors driven accordingly.

The servomotors are interconnected via a common regulation system so that, for example, the rotational angle of the one servomotor is queried and subsequently the rotational angle of the other servomotor(s) is adjusted accordingly.

The invention thus comprises essentially the combination of the following characteristics:

1. An electronically regulated servomotor acts as drive unit for the bending tool via at least one rotationally driven cam onto a lever, on which is rotationally disposed at least one bending roller, at the outer circumference of which the wire is bent.

2. A further electronically regulated servomotor is used as the drive unit for the production of the spring pitch, which drive motor is connected so as to be torsion tight with a rotationally driven cam wheel which oscillatingly drives a ram; this ram is connected with the pitching tool which comes into contact on the prebent wire and applies the spring pitch.

Through combination of these two bending tools in connection with rotational angle-regulated servomotors the above formulated problem is solved. Since in the transmission chain of each drive train for the production of the wire bend and the wire pitch only few transfer elements are present, which, furthermore, are implemented so as to be rigid and without significant play, it is now possible for the first time to bend the spring with the requisite high accuracy.

Thus a rigid and torsionally-tight drive train for the production of the spring curvature and the spring pitch is suggested such as was not known previously.

A further development of the present invention provides that the mechanism for drawing in the wire is also equipped with a servomotor regulated as a function of rotation number or rotational angle and this servomotor acts via a transmission onto the synchronously driven tension rollers. Driven opposingly, these form between them a gap through which the wire is drawn in and transported. A multi-step reduction gearing is preferably used herein which is implemented as spur gearing. Instead of the described spur gear an angular or a belt gearing can also be used.

It is also possible to couple the servomotor directly with the tension rollers or to assign each individual tension roller to individual servomotors.

Above was described that the transfer elements between the servomotors and the bending tools should be realized as simple and free of play as possible and should operate rigidly and resistant to torsion.

In a further embodiment according to the present invention it is suggested that the bending tools are in each instance moved only translationally, i.e. they are each only driven in one plane and as displacement drive for the particular bending tool other torsion-tight and rigid drives are also claimed as being essential to the solution of the problem.

It is herein preferred if for example the bending roller is guided in a carriage, such carriage is driven via a spindle in order to assign to the bending roller a translational displacement drive.

Instead of the pivot drive described in the first embodiment example of the bending roller, a purely translational drive of the bending roller is thus realized.

It is also possible to assign to the bending roller a combination of a translational as well as also a pivot drive.

When using a spindle drive for the bending and pitching tools, the advantage exists that in the event of a power failure to the self-locking of the spindle the tools remain in their starting position and no further change occurs.

The same explanations apply also to the pitching tool which can also be driven directly and translationally. Herein the pitching tool is again seated in a carriage which is driven via a spindle drive or another translational drive.

It is understood that it is possible to implement the pitching tool also as pivot tool with a translational and/or pivot motion provided for the pitching tool.

In a further development of the present invention it is provided that the cutting tool is also driven via an electronically regulated servomotor. Herein, again, short connections between servomotor and cutting tool are critical in order to be able to execute a precise cut. Preferred is herein a direct drive of the cutting tool via an articulated lever whose extended position is controlled by a cam which, rotationally driven, is in contact with the articulated lever and deflects it accordingly. Directly on the articulated lever is disposed the displaceably driven upper cutter which opposes a stationary lower cutter.

The use of an articulated lever has the advantage that relatively large cutting forces can be generated at low driving power of the servomotor.

According to a further characteristic of the present invention it is provided that the wire is no longer supplied to the bending tool through a so-called wire guide tube but a free feeding of the wire takes place without guiding the wire through a corresponding guide tube. Instead of a tube, now according to the invention wire guide rollers are disposed offset with respect to one another in the direction of transport. One of the wire guide rollers comes into contact with the wire at the top and the other wire guide roller at the bottom and the two wire guide rollers are disposed offset in the direction of transport with respect to one another.

The two wire guide rollers offset with respect to one another in the direction of transport form with the bending tool, implemented as bending roller, a three-point support for the wire guided through between these three rollers which leads to an especially stable and twist-free wire guidance. Therefore, the previously provided wire guide tube can be omitted which had the disadvantage that the wire always rested on the exit edges of the wire guide tube and resulted in increased wear and contamination of the tube. The increased danger of contamination led to the disadvantage that the wire guide tube became partially occluded and generated thus a different support and guidance point for the wire guided in the wire tube. This entailed an impairment of the curvature accuracy of the spring to be produced.

The subject matter of the invention of the present invention is evident not only based on the subject matter of the individual claims but also from the combination of the individual claims.

All specifications and characteristics disclosed in the application, including the abstract, in particular the spatial implementation depicted in the drawings are claims as essential to the invention to the extent they are individually or in combination novel relative to prior art.

Figure 2:
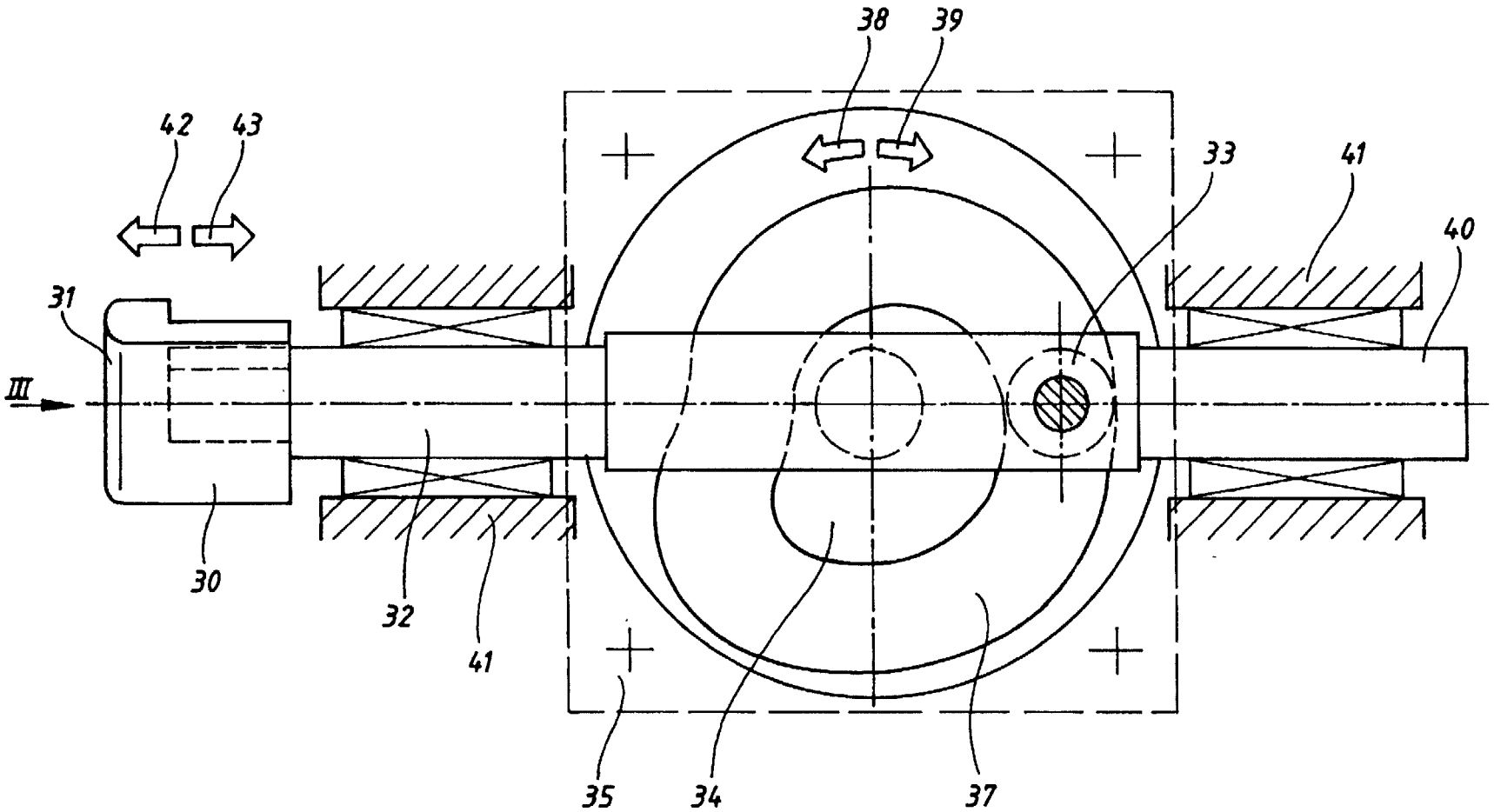
Figure 3:
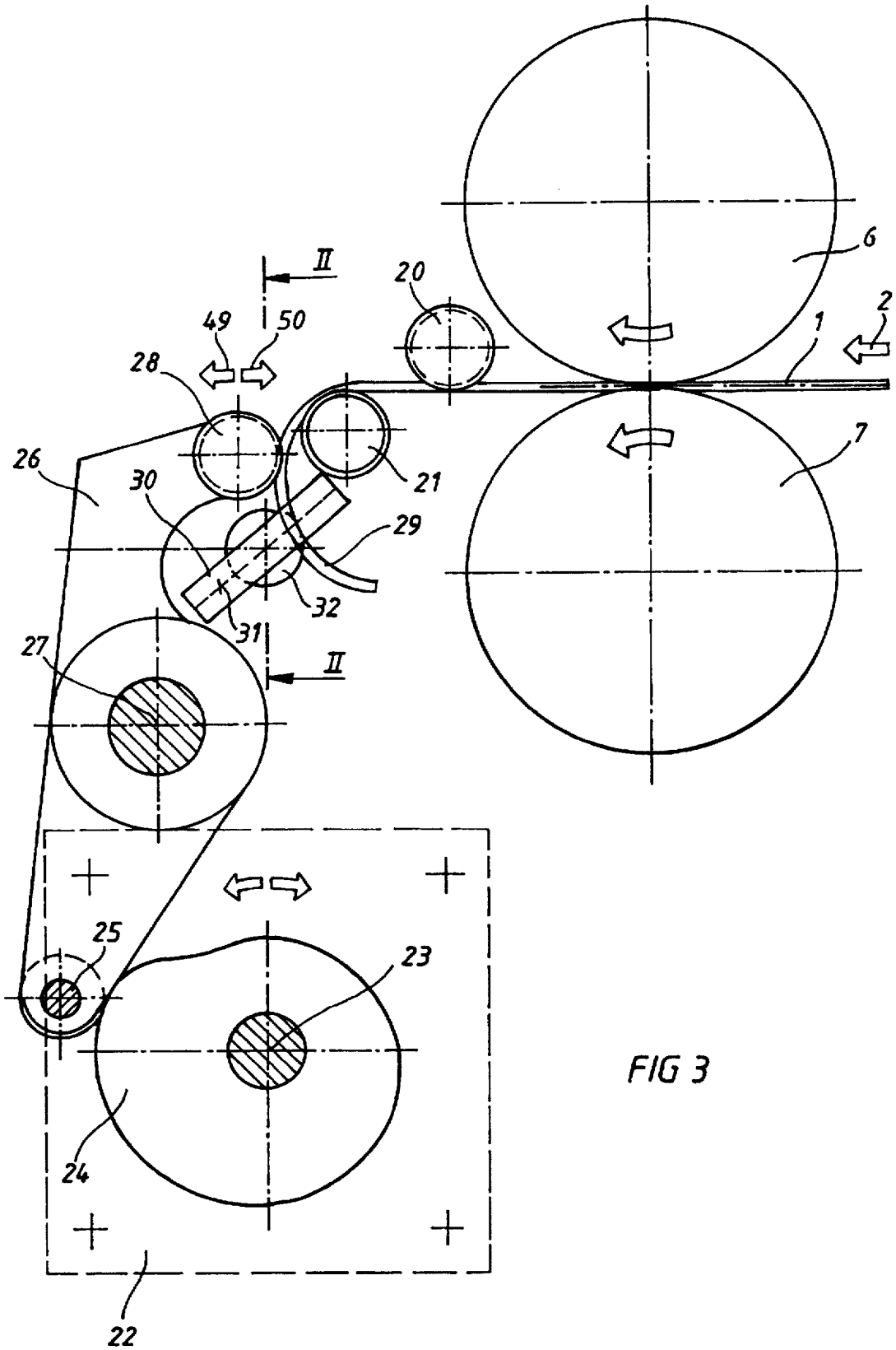
Figure 4:
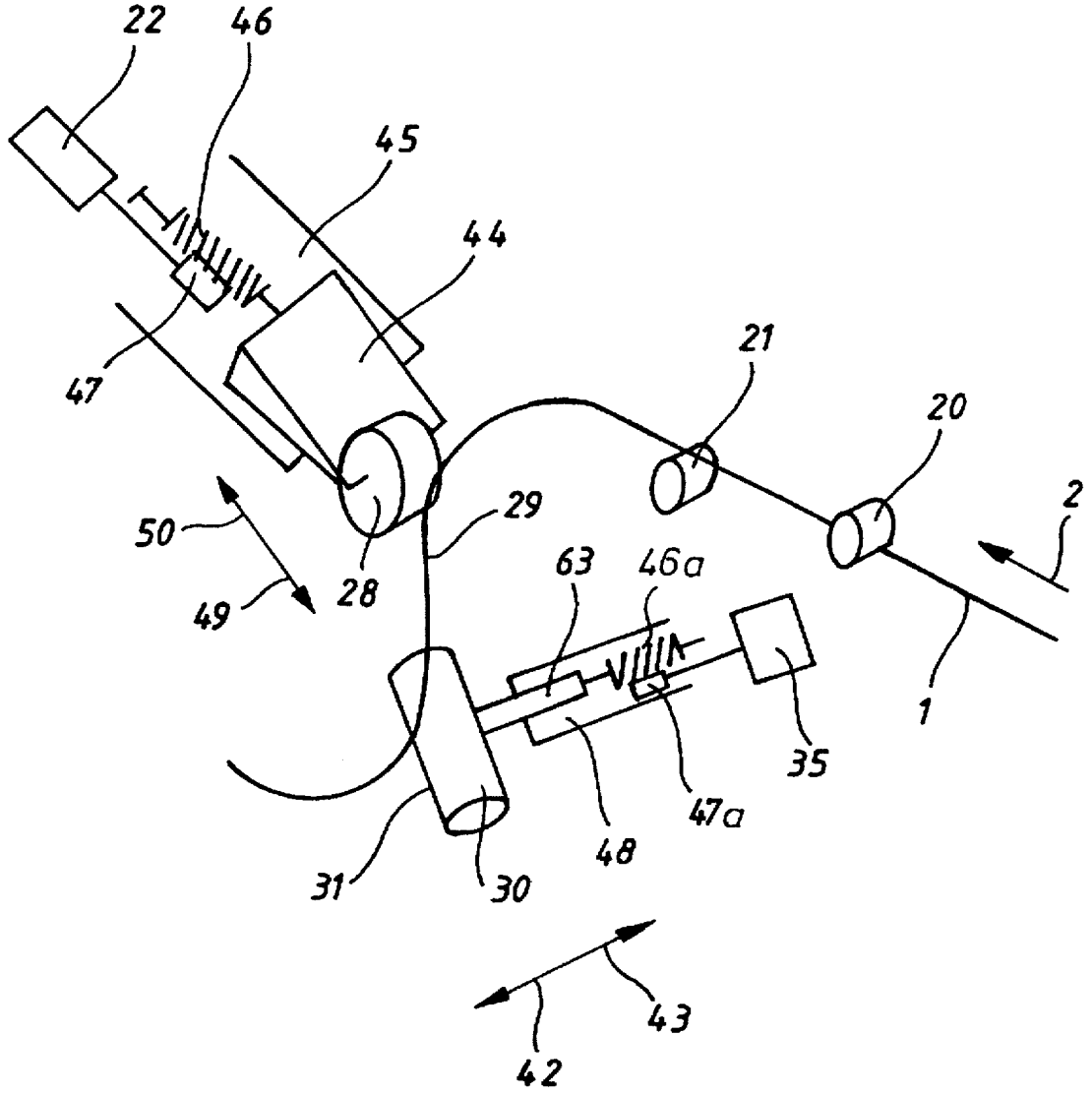
Figure 5:
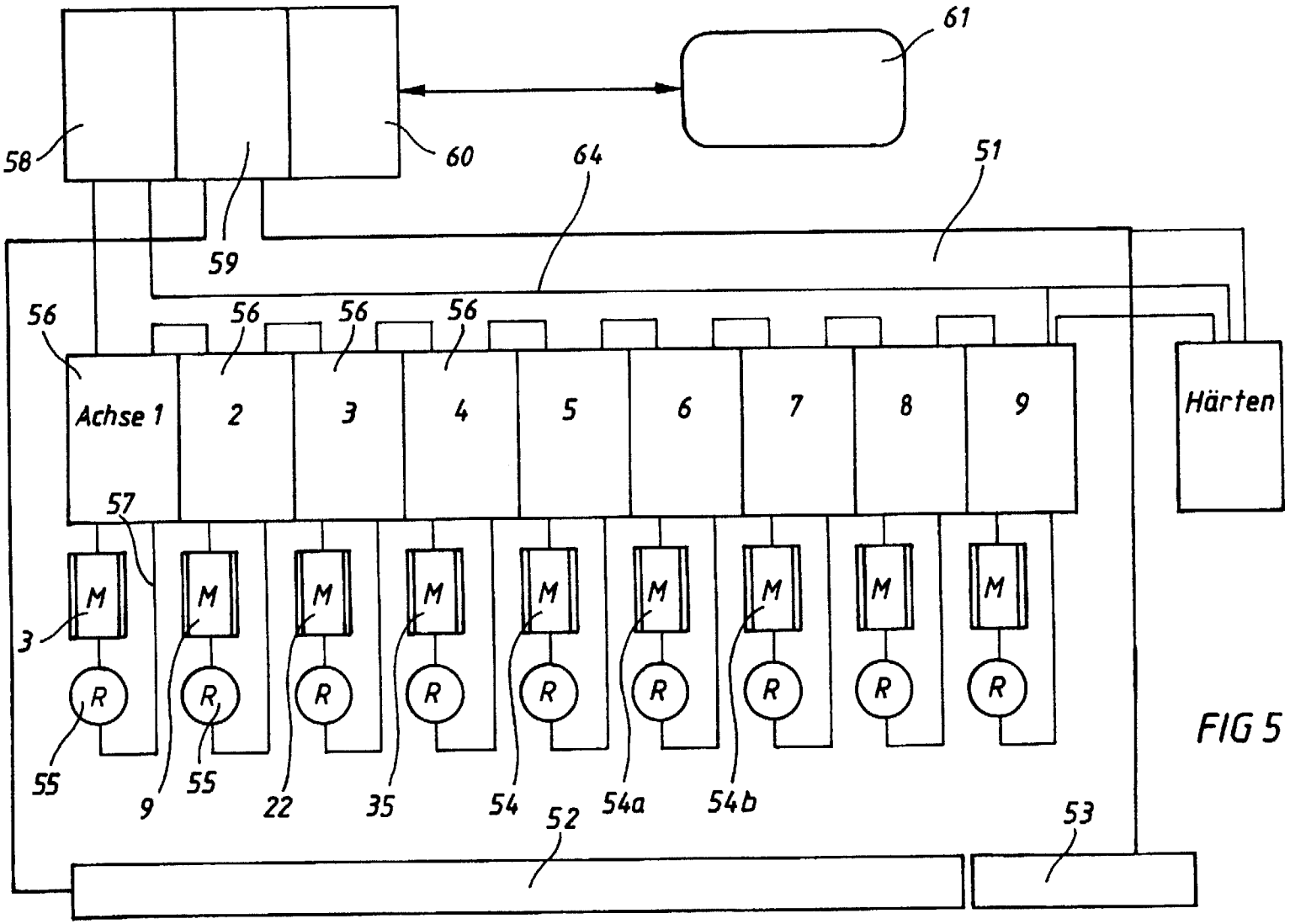

In the following the invention will be explained in further detail in conjunction with drawings representing only one embodiment example. The drawings and their description show further characteristics and advantages of the invention essential to the invention. Therein depict:

FIG. 1 perspective view of a bending machine shown schematically;

FIG. 2 view onto the pitching tool and its drive in the direction of arrow II in FIG. 1;

FIG. 3 side view of the configuration according to FIG. 2 in the direction of arrow III in FIG. 2;

FIG. 4 schematically a timber embodiment example for the displacement drive of the bending tools;

FIG. 5 schematically the control of the coiling machine.

According to FIGS. 1 to 3 a wire 1 is guided in the direction of arrow 2 through tension rollers 6, 7 and driven by them in the direction of advance. The tension rollers are driven synchronously via a common gearing 5 and are acted upon by a drive axle 4 which is driven by a rotational angle-controlled servomotor 3.

The bending device 8 comprises essentially a bending tool implemented as bending roller 28, and a pitching tool 30.

The bending roller 28 is herein driven by a rotational number-regulated servomotor 22 while the driving of the pitching tool 30 takes place via a rotational number-regulated servomotor 35.

In the following the short torsion-resistant and rigid drive train for the bending roller 28 will be described.

The servomotor 22 drives via a drive axle 23 a cam 24 which is mounted with its outer circumference on the outer circumference of a roller 25. The roller 25 is disposed on the free pivotable portion of a lever 26 which is rotationally supported in the pivot axis 27.

On the opposing arm the bending roller 28 is seated which accordingly during the pivoting of roller 25 is displaceably driven in the directions of arrow 49, 50 (cf. FIG. 3).

By disposing the bending roller 28 on a rigid bending-resistant lever 26 and the direct pivot drive of this lever 26 through the servomotor 22 thus a pivot drive is realized which with low play and high accuracy acts upon the bending roller 28.

The displacement drive of the pitching tool 30 is solved in a similar manner. The servomotor 35 drives herein rotatingly via its drive axle 36 a cam wheel 34 (cf. FIG. 2). The cam wheel 34 defines a curve pathway 37 in which a roller 33 is guided so as to be translationally displaceable. Herein the roller 33 according to FIG. 2 is disposed rotatably but nondisplaceably on a ram 32 displaceable in the directions of arrow 42, 43 supported in the region of straight guidance 41. The front end of the ram 32 is connected with the pitching tool 30, which comprises a contact tip 31 with which the pitching tool 30 comes into contact with the wire section 29 to be bent.

Thus first the wire curvature is formed with the bending roller 28, i.e. the spring diameter is set, while with the pitching tool the pitch of the spring is introduced.

Thus, when the cam 34 is driven rotatingly in the directions of arrow 38, 39, consequently the entire ram is displaced in the directions of arrow 42, 43. In order to ensure maximum play-free guidance, it is provided that the pitching tool 30 is disposed on the one side of the cam while at the opposing side an extension 40 of the ram is disposed which is guided in the straight guidance 41. In this way, two oppositely directed straight guidances 41 are realized outside of the cam disk 34, which ensure the play-free straight guidance of ram 32.

As explained above, an especially precise cut is realized. For this purpose a servomotor 9 is provided which acts via its drive axle 10 onto a gearing 11. The axis of rotation 15 of this gearing is coupled torsion-resistant with a cam 12. The outer circumference of the cam 12 comes at its outer circumference into contact with an associated roller 16 which is rotatably disposed in the pivotable portion of an articulated lever 62. The articulated lever is disposed stationary in the housing and is pivotably supported in the pivot axis 17. In the region of its axis of rotation 18 it receives the roller 16.

At the other lever end a pivot axis 19 is disposed in which the upper cutter 13 is mounted, guided in a straight guidance not further depicted.

The upper cutter 13 is opposed by a lower cutter 14 disposed stationary in the housing.

It was already stated in the general description that by omitting the so-called wire guidance tube in the direction of transport behind tension rollers 6, 7, a further improvement of the spring quality is achieved. To this end is provided according to FIG. 3 that in the direction of transport are successively disposed wire guidance rollers 20, 21 which are offset relative to one another and the wire guidance roller in front guides the wire from above while the wire guidance roller 21 disposed behind guides the wire from below. The wire guidance roller 21 should herein be disposed at a fixed distance from the bending roller 28.

All three rollers 20, 21,28 together form in this way a stable three-point guidance of the wire so that a wire guidance tube can be omitted. Thus one danger for contamination is omitted for the previously present wire guidance tube and unique defined support points on the wire are formed which previously had not been defined.

Since it is provided that tile wire guidance rollers 20, 21 are realized rotatably, a correspondingly lower wear exists because with the previous wire guidance tubes continuous friction with corresponding contamination had to be accepted.

Reference is made to the fact that for the type and arrangement of the wire guidance rollers 20, 21 in connection with the bending roller 28 separate protection, independently of the above cited other characteristics is claimed.

In FIG. 4 a further embodiment of the invention is depicted. It is herein evident that the movements of tile individual tools 28, 30 can be executed through purely translational movements.

The bending roller 28 is herein rotatably supported in the region of a carriage 44 which is received in a guide 45. The carriage 44 is here for example connected with a spindle 46 which is rotatingly driven by a spindle nut 47 which, in turn, is driven by the servomotor 22. In this way the carriage 44 is moved translationally in the directions of arrow 49, 50 in the guide 45 and a practically play-free low-loss and rigid translational guidance of the bending roller 28 results also.

In the same way the translational guidance of the pitching tool 30 is solved. This pitching tool is also disposed on a carriage 63 which is guided displaceably in a guide 48. In this same way this carriage 63 is connected with a spindle **46*a* on which a spindle nut 47*a* is in contact and drives the spindle. The spindle nut is herein driven rotatingly by the servomotor 35**.

Thus, in this way a purely translational drive in the directions of arrow 42, 43 is realized which operates especially with low play and high rigidity.

It is understood that combinations of a pivot drive described with reference to the bending roller 28 in FIG. 1 and the translational drive depicted in FIG. 4 can be realized. The same applies moreover also to the implementation of the translational drive of the pitching tool 30 which can be replaced by a pivot drive of the type of drive of the bending roller 28.

In FIG. 5 is depicted schematically a regulation according to the invention. Herein in the regulator 51 motor regulator 56 are comprised with which the individual motors 3, 9, 22, 35 are regulated as a function of the number of rotations and the rotational angle. With each motor a rotational angle sensor 55 is associated which detects the current angle of rotation and feeds it via the feedback 57 to the motor regulation 56.

At the input of the motor regulator 56 is disposed the axle control 58 which introduces the control commands into the motor regulator 56. Thus in the axle control 58 the mathematical model is given for generating the desired spring and these electrical control commands are subsequently fed into the individual axles. The feedback of the individual commands and the interconnection of the individual motor regulator 56 takes place via a fiberoptic ring which accepts all commands and sends them back onto the axle control 58 in the sense of a bus.

The axle regulator is coupled to a memory-programmable control 59 which can be driven by a computer 60. The corresponding control commands can be entered via an operating terminal 61.

In regulator 51 further regulation mechanisms are depicted. It is indicated that regulator 51 can also be used, with the aid of motors 54, **54*a*, 54*b*** to form knots in the springs and that outside of the coiling part a transport star can be provided.

While in FIG. 1 the coiling part was described, in FIG. 5 schematically the entire coiling machine 52 is shown which is connected via corresponding lines to the control 59 in order to control the other movement processes of the coiling machine.

The coiling machine 52 is also connected with a transferring machine 53 which accepts the finished bent springs and transports them further.

We claim:

1. Electronically-regulated coiling apparatus for mattress and upholstery springs comprising essentially a wire drawin, a wire guide, a cutting device and a bending device for a wire to be processed, characterized in that the bending device is formed of at least one bending roller (28) and at least one pitching tool (30), with a servomotor (22) directly rotatably driving at least one cam wheel (24) onto one end of a lever (26) pivotable about an axis (27) and pivotably drives the bending roller (28) disposed at the opposing end of the lever (26), and a servomotor (35) directly rotatably driving at least one cam wheel (34), which defines a curve path (37) in which a ram (32) is guided displaceably translationally, which supports at one end the pitching tool (30).

2. Electronically-regulated coiling apparatus for mattress and upholstery springs comprising essentially a wire draw-in, a wire guide a cutting device and a bending device for a wire to be processed, characterized in that the bending device is formed of at least one bending roller (28) and at least one pitching tool (30) and the bending roller (28) is supported on a carriage (44) which is translationally driven via a spindle (46) rotatably driven by a servomotor (22), and the pitching tool (30) is supported on a carriage (63) which is translationally driven via a spindle (46*a*) rotatingly driven by a servomotor (35), said wire guide comprising at least two rotatable wire guide rollers disposed one behind the other in the direction of transport(2) which form, with the bending roller (28) disposed behind them, a three-point support for the wire (1).

3. Electronically-regulated coiling apparatus as defined in claim 1, characterized in that the wire draw-in comprises at least one servomotor (3) which opposingly drives synchronously via a gearing (5) at least two tension rollers (6, 7).

4. Electronically regulated coiling apparatus as defined in claim 3, characterized in that the tension rollers (6, 7) are each driven by one servomotor (3).

5. Electronically regulated coiling apparatus as defined in claim 1, characterized in that the wire guide comprises at least two rotatable wire guide rollers (20, 21) disposed one behind the other in the direction of transport (2), which form with the bending roller (28) disposed behind them a three-point support for the wire (1).

6. Electronically regulated coiling apparatus as defined in claim 1, characterized in that the cutting device is actuated via an articulated lever (62) which is actuated by a servomotor (9) via a cam (12).

7. Electronically regulated coiling apparatus as defined in claim 1, characterized in that the servomotors (3, 9, 22, 35) are regulated as a function of the rotation number and angle.

8. Electronically regulated coiling apparatus as defined in claim 1, characterized in that the servomotors (3, 9, 22, 35) are each coupled with a rotational angle sensor (55).

9. Electronically regulated coiling apparatus as defined in claim 1, characterized in that the form of the springs to be produced is stored as mathematical models in a computer (60) which by means of electrical control commands are supplied to a programmable control (59), an axle control 58 and a regulation (51).

* * * * *